US011134759B2

(12) United States Patent
Keeler et al.

(10) Patent No.: US 11,134,759 B2
(45) Date of Patent: Oct. 5, 2021

(54) ILLUMINATED JEWELRY SYSTEM AND METHODS OF MAKING SAME

(71) Applicants: Matthew Len Keeler, Bolton, MA (US); Kristin E. Kearns, Biktib, MA (US)

(72) Inventors: Matthew Len Keeler, Bolton, MA (US); Kristin E. Kearns, Biktib, MA (US)

( * ) Notice: Subject to any disclaimer, the term of this patent is extended or adjusted under 35 U.S.C. 154(b) by 0 days.

(21) Appl. No.: 14/819,549

(22) Filed: Aug. 6, 2015

(65) Prior Publication Data

US 2016/0037883 A1 Feb. 11, 2016

Related U.S. Application Data

(60) Provisional application No. 62/033,994, filed on Aug. 6, 2014.

(51) Int. Cl.
*A44C 15/00* (2006.01)
*A44C 25/00* (2006.01)

(52) U.S. Cl.
CPC ..... *A44C 15/0015* (2013.01); *A44C 25/00* (2013.01)

(58) Field of Classification Search
CPC ..... A44C 15/005; A44C 15/0015; A44C 15/0045
See application file for complete search history.

(56) References Cited

U.S. PATENT DOCUMENTS 5,477,433 A * 12/1995 Ohlund ..... A44C 15/0015 362/104
6,233,971 B1 * 5/2001 Ohlund ..... A44C 15/0015 362/104
7,104,668 B1 * 9/2006 Lee ..... A44C 15/0015 362/103
7,441,917 B1 * 10/2008 Underdown ..... A44C 15/0015 362/103
2004/0196650 A1 * 10/2004 Phlippeau ..... A44C 17/006 362/103
2005/0002180 A1 * 1/2005 Kamara ..... A44C 15/0015 362/104
2005/0174800 A1 * 8/2005 Clegg ..... A44C 15/0015 362/571
2006/0262531 A1 * 11/2006 Schrimmer ..... A44C 15/0015 362/240
2006/0291210 A1 * 12/2006 Lee ..... A44C 15/0015 362/249.01
2008/0048609 A1 * 2/2008 Kuhlmann ..... H02J 7/0042 320/107
2009/0044566 A1 * 2/2009 Underdown ..... A44C 15/0015 63/3

(Continued)

*Primary Examiner* — Emily M Morgan
(74) *Attorney, Agent, or Firm* — Pandiscio & Pandiscio

(57) ABSTRACT

The present invention generally relates to an illuminatable jewelry system having a jewelry element containing a controllable light source. By way of example, the jewelry element may be transparent or translucent. The jewelry may also have other types of decorative elements attached to a length of conductive jewelry wire. A power cell having a solar cell, an energy harvesting circuit and a rechargeable battery are in electronic communication with the light source. Magnetic connectors permit the illuminatable jewelry system to be worn and operate to complete an electrical circuit between the power cell and the light source.

8 Claims, 6 Drawing Sheets

(56) References Cited

U.S. PATENT DOCUMENTS

| | | | | |
|---|---|---|---|---|
| 2012/0324947 | A1* | 12/2012 | Opperman | A44C 5/2057 63/3.1 |
| 2014/0230487 | A1* | 8/2014 | Vasguez | A44C 15/0015 63/1.11 |
| 2014/0338397 | A1* | 11/2014 | Andreini, III | A44C 15/005 63/1.14 |
| 2015/0164188 | A1* | 6/2015 | Gelfand | A44C 15/0015 63/1.13 |

* cited by examiner

ILLUMINATED JEWELRY SYSTEM AND METHODS OF MAKING SAME

PRIORITY CLAIM

The present application claims the benefit of the filing date of U.S. Provisional Patent Application No. 62/033,994, and wherein its subject matter is incorporated by reference herein in its entirety.

FIELD OF THE INVENTION

The present invention generally relates to illuminated jewelry systems or jewelry systems that may be selectively illuminated (i.e., illuminatable jewelry) and methods for making the same. More specifically, the assembly of these jewelry systems may permit an end user to customize lighting elements (e.g., light emitting diodes (LEDs) into a wide variety of jewelry systems, which will be described in more detail below.

SUMMARY

The present invention generally relates to a system for illuminating transparent jewelry elements such as, but not limited to, glass beads, clear acrylic elements or translucent stones that may be part of a larger piece of jewelry such as a bracelet or a necklace. Transparent and translucent jewelry elements are broadly referred to as illuminatable jewelry elements herein. The jewelry system may include a small light source such as, but not limited to, a light emitting diode (LED) attached to stringing material, a power source and a connector designed to enforce polarity requirements for the illuminatable jewelry elements.

In one aspect of the present invention, an illuminatable jewelry system includes a length of jewelry stringing wire; a first magnetic connector coupled to a first end of the wire; a second magnetic connector coupled to a second end of the wire; a jewelry element made from a material that permits visible light to travel through a thickness of jewelry element; a light source located in the jewelry element; and a power cell coupled between the first and second magnetic connectors, the power cell in electronic communication with the light source to selectively modulate the visible light emanating from the light source.

BRIEF DESCRIPTION OF THE DRAWINGS

In the drawings, identical reference numbers identify similar elements or acts. The sizes and relative positions of elements in the drawings may not be necessarily drawn to scale. For example, the shapes of various elements and angles may not be drawn to scale, and some of these elements may be arbitrarily enlarged or positioned to improve drawing legibility. Preferred and alternative embodiments of the present invention are described in detail below with reference to the following drawings.

DETAILED DESCRIPTION

In the following description, certain specific details are set forth in order to provide a thorough understanding of various embodiments of the invention. However, one skilled in the art will understand that the invention may be practiced without these details. In other instances, well-known structures associated with jewelry, to include assemblies, subassemblies and detail components thereof, and methods of using, assembling and installing any of the above may not have been shown or described in detail to avoid unnecessarily obscuring descriptions or other aspects of the embodiments of the invention. For purposes of the description and claims herein, the term "jewelry" should be broadly interpreted to mean any type of gem, rock, precious metal, trinket medallion, brooch, pin pendant, as well as any physical element that may be considered to have aesthetic beauty or and/or other aesthetic qualities.

Figure 1A:
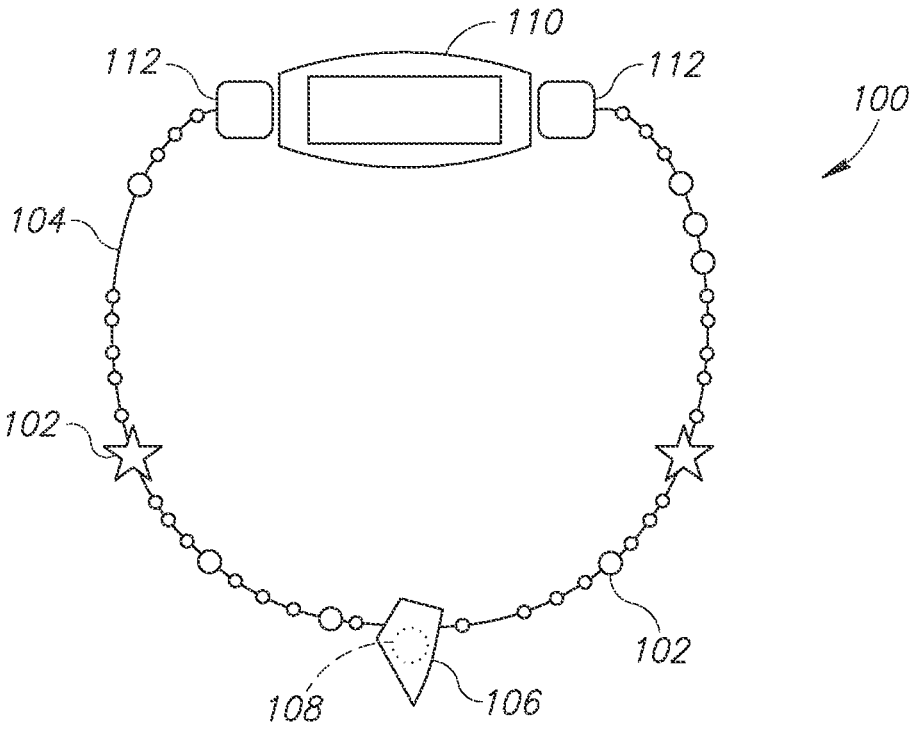
FIG. 1A is a front plan view of an illuminating jewelry system with a power cell according to an embodiment of the present invention.

FIG. 1A shows a jewelry system 100 having decorative elements 102 attached to stringing material 104 according to an embodiment of the present invention. The decorative elements 102 may take the form of beads, gems, stones, etc. that may be part of a larger piece of jewelry such as a bracelet or a necklace. In addition, the jewelry system 100 includes an illuminatable element 106 made from a material that allows light to penetrate through a wall thickness or total thickness of the illuminatable element 106, in which the latter further includes a light source 108 (not shown) such as, but not limited to a light emitting diode (LED). A power cell 110, such as a solar cell, may be located between magnetic clasps 112 (i.e., magnetic connectors). The power cell 110 may take the form of a solar powered component or battery that stores and delivers electrical current. By way of example, the solar powered components may take the form of a self-contained solar rechargeable battery. In one embodiment, the power cell 110 is completely enclosed, and has no moving, removable or serviceable parts. The battery within the power cell 110 may be re-charged using a small solar panel. The magnetic clasps 112 are configured to enforce the polarity requirements for activating the illuminatable element 106.

The illuminatable elements 106 may take the form of glass beads, clear acrylic elements, translucent stones, or any other type of material that allows some amount of visible light penetration through its thickness. The decorative elements 102 may also be transparent or translucent, and likewise the light source 108 may be small enough to thread through and into the decorative elements such as, but not limited to, stones or beads. Overall, the various system components are compatible with a variety of other jewelry components both in function and in aesthetics.

For example in one embodiment, the stringing material 104 may take the form of an industry standard nylon-coated multi-strand silver, copper or brass wire (also referred to as beading wire) designed for beaded jewelry. The stringing material 104 operates as a structural element and as a conductive electrical element to complete the electric circuit between the power cell 110 and the light source 108. The nylon coating prevents accidental electrical shorts. Electrical connections may be secured with aesthetically compatible jewelry crimps.

Figure 1B:
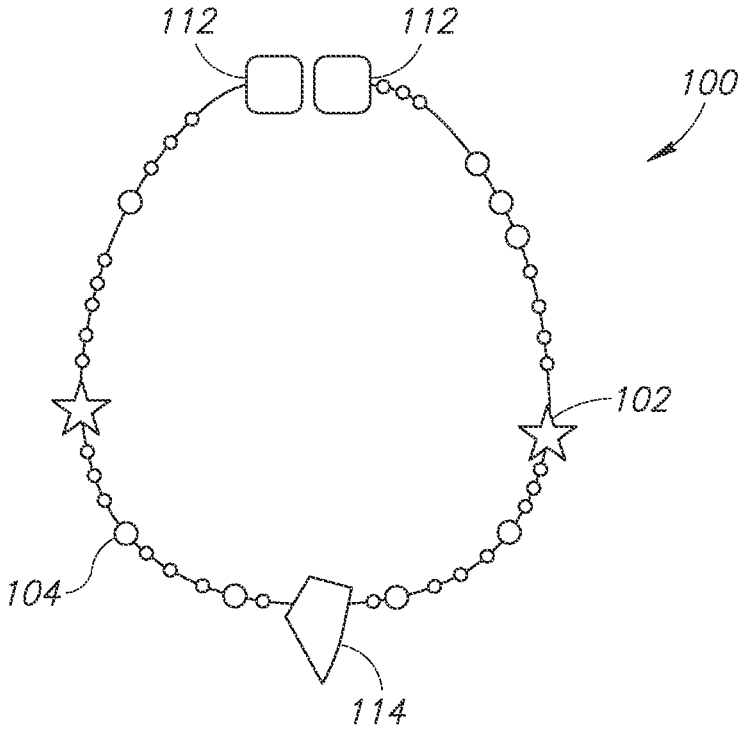
FIG. 1B is a front plan view of an illuminating jewelry system without a power cell according to an embodiment of the present invention.

FIG. 1B shows the jewelry system 100 with the power cell 108 removed for recharging or merely because the wearer does not want the illuminatable jewelry element 106 to be lit for whatever reason. In one embodiment, the power cell 110 may be recharged by removing the power cell 110 while leaving behind the unlit jewelry element 114. Further as shown in FIG. 1A, the power cell 110 may be connected with two conductive/magnetic connections 112, one on each side of the power cell 110.

The jewelry system 100 may be provided to the end user fully assembled and ready to accept beads. The end user may thread the light source 108 into a focal element such as a transparent or translucent bead or stone.

Figure 2:
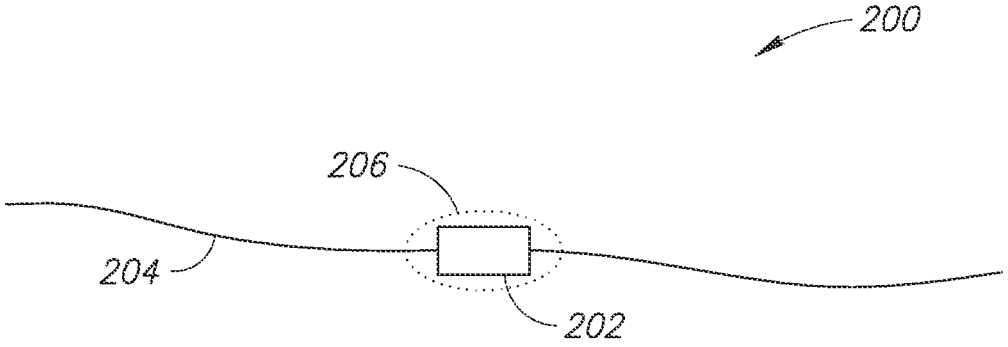
FIG. 2 is a partial, schematic view showing an encapsulated light source according to another embodiment of the present invention.

FIG. 2 shows an embodiment of an LED 200 assembly in which an LED 202 is coupled to jewelers beading wire 204. The LED 202 is encapsulated within a housing 206 made of epoxy or cyanoacrylate. By way of example, the LED 202 may be sized to measure less than one millimeter (mm) in width. The wire 204 should preferably be compatible with both standard soldering practices and be commonly used in jewelry making (sterling silver, copper, brass, etc.). The soldered connections may be insulated and mechanically reinforced with cyanoacrylate or clear epoxy. The solder connections and the housing 206 may not fully support the weight and mechanical stresses of a piece of jewelry. Additional mechanical strength may be obtained by adhering or otherwise fastening the LED 202 and some of the surrounding wire 204 into or onto the bead or stone to be illuminated.

Figure 3:
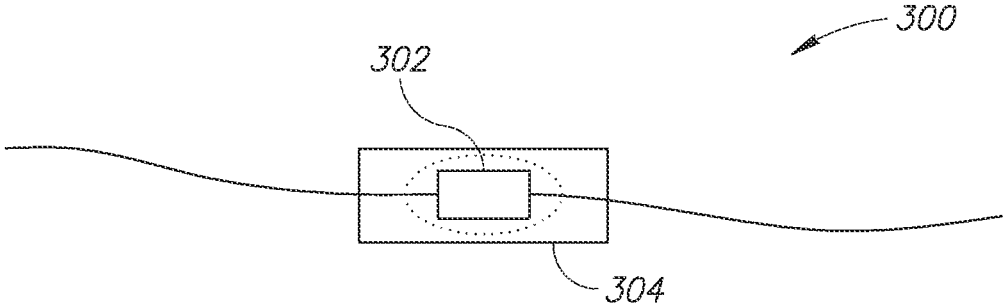
FIG. 3 is a partial, schematic view showing a light source within a capillary tube according to another embodiment of the present invention.

FIG. 3 shows an LED assembly 300 having an LED 302 secured in a glass capillary tube 304. In one embodiment, the LED 302 is adhered into a reinforced, frosted glass capillary tube 304. In this embodiment, additional mechanical reinforcement may not be necessary. The glass capillary tube 304 may be supplied with a texture or a color that modifies and/or enhances various properties of the visible light emanating from the LED 302.

Figure 4A:
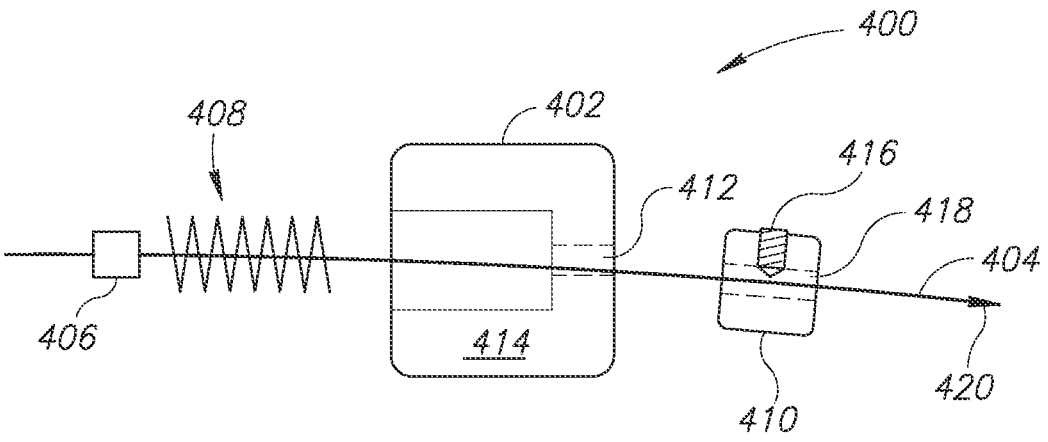
FIG. 4A is a pre-assembled schematic view of a magnetic connector assembly according to another embodiment of the present invention.
Figure 4B:
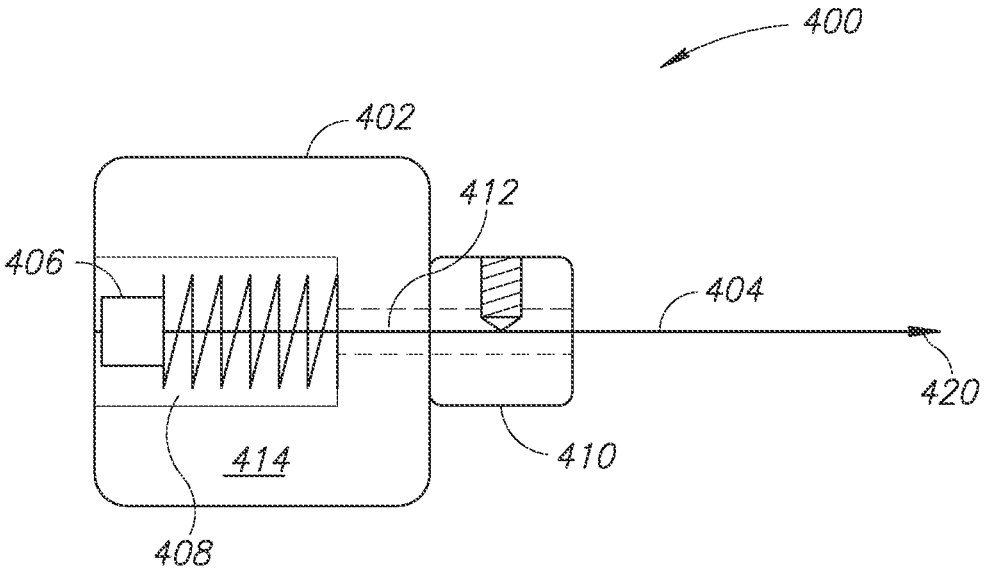
FIG. 4B is an assembled schematic view of a magnetic connector assembly according to another embodiment of the present invention.

FIGS. 4A and 4B show a magnetic connector assembly 400 before and after a magnetic connector 402 is crimped or secured to a section of electronically conductive jewelers beading wire 404 (hereinafter "conductive wire") according to an embodiment of the present invention. The magnetic connector assembly 400 includes the magnetic connector 402, a jewelry crimp 406, a spring 408 and a screw-type crimp 410.

In one embodiment, the end user attaches each magnetic connector 402 to the two separate sections of the jewelers beading wire 404 after the wire has been strung with beads or other decorative elements.

Magnets are now commonly used as clasps within the jewelry industry. In the illustrated embodiment, the magnetic connector 402 includes a small hole 412 for threading the conductive wire 404, and a larger hollow region 414 to house and secure the jewelry crimp 406. Preferably, the magnetic connector 402 is coated with a conductive silver finish, but it is appreciated the coating or finish may be made of another material or combination of materials such as, but not limited to, gold or copper. The jewelry crimp 406 may take the form of a crushable-tube crimp (hereinafter referred to as the "tube crimp"). The end user deforms and crushes tube crimp 406 around the conductive wire 404. In the jewelry industry, such a tube crimp 406 typically functions as a mechanical stop. In this illustrated embodiment, the tube crimp 406 pierces a nylon coating protecting the conductive wire 404 to make an electrical connection.

The screw-type crimp 410 takes the form of a re-useable, non-deformable tube with a small set screw 416 perpendicular to a central channel 418. As shown in the illustrated embodiments of FIGS. 4A and 4B, the end user threads the wire 404 through the screw-type crimp 410 without tightening the screw 416, through the magnet 402, and through a small spring 408, then through the jewelry crimp 406 To finish assembling the magnet connector assembly 400, the end user pulls back on the wire 404 in direction of the arrow 420 and then tightens the set screw 416. Torqueing the set screw 416 pierces the nylon coating or any other type of non-conductive coating on the wire 404 to make the electrical connection while fixing the magnet 402 to the wire 404. The coiled spring 408 insures that electrical contact is present between the wire 404 and the conductive surface of the magnet 402, via one or both of the crimps 406, 410.

Figure 5A:
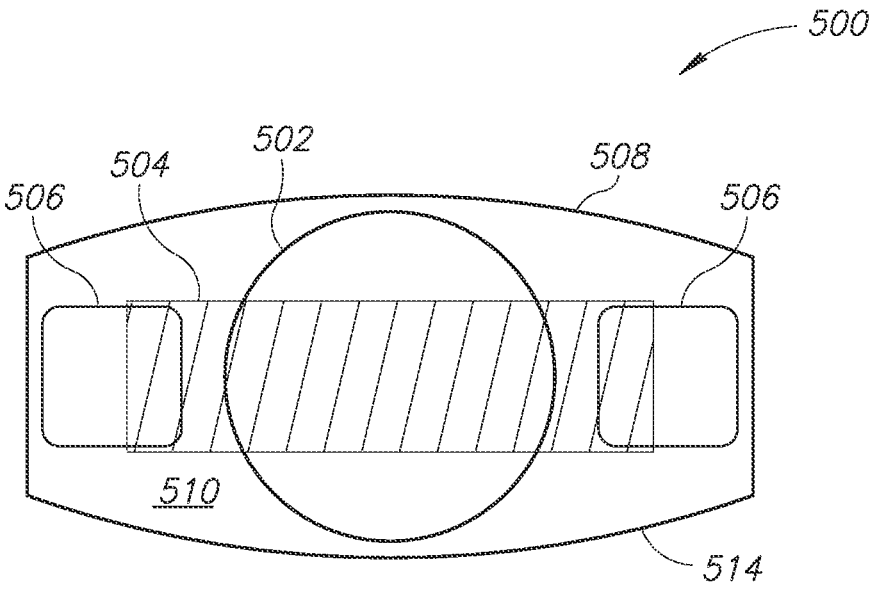
FIG. 5A is a top plan view of a power cell assembly according to an embodiment of the present invention.
Figure 5B:
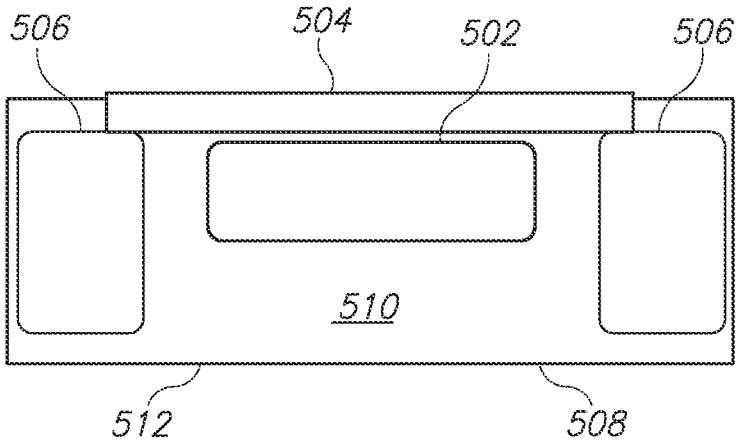
FIG. 5B is a side elevational view of the power cell assembly of FIG. 5A.

FIGS. 5A and 5B show a magnetic power cell 500 according to an embodiment of the present invention. In one embodiment, the magnetic power cell 500 is provided to the end user fully assembled and ready to insert between the two magnetic connectors 112 (see FIG. 1A). The power cell 500 includes a rechargeable battery 502, a solar cell 504, two magnets 506 coupled to each end of the solar cell 504, and a decorative housing 508. In one embodiment, the housing 508 may be filled or at least partially filled with an epoxy resin material 510 to add structural stability, and to secure and insulate the various components. The housing 508 may take the form of a three-sided housing with a flat bottom panel 512 (see FIG. 5A) and two curved side panels 514 (see FIG. 5B). The housing 508 may be made from a thin gauge decorative material such as, but not limited to, silver, copper, brass, or plastic. An active area of the solar cell 504 may be exposed to an ambient environment.

Figure 6:
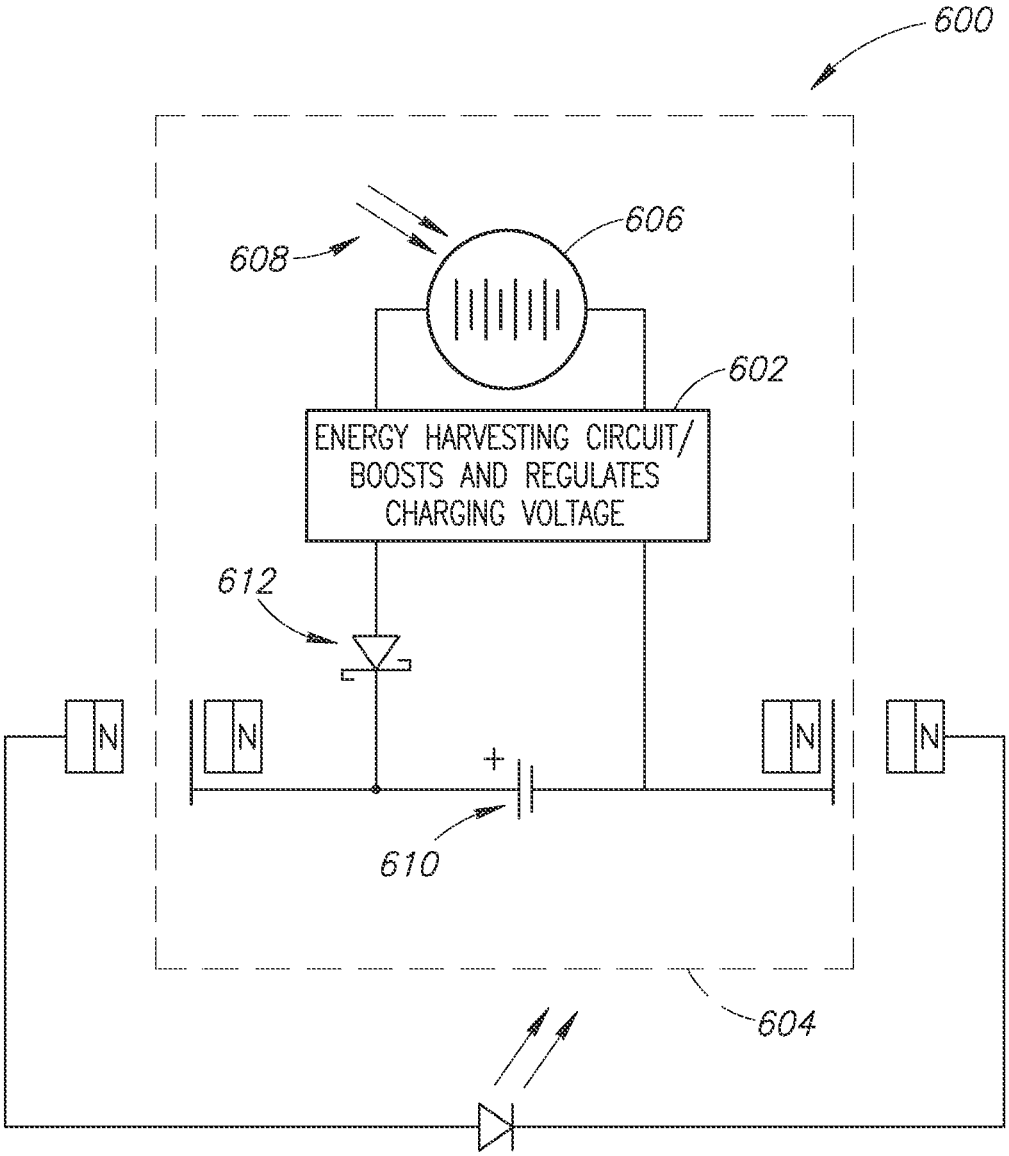
FIG. 6 is a schematic diagram for an illuminating jewelry system having an energy harvesting circuit according to an embodiment of the present invention.

FIG. 6 shows a schematic diagram 600 that includes an energy harvesting circuit 602 within a power cell 604 configured to be electrically efficient, and use one or more energy harvesting technologies. A solar cell 606 forms a portion of the energy harvesting circuit 602 and may include several cells in series for the energy harvesting circuit to work efficiently. By way of example, when the solar cell 606 is exposed to light 608 then a voltage is generated across its terminals. Energy from the solar cell 606 may be transformed into an appropriate voltage for charging a battery 610 via the energy harvesting circuit 602. The battery 610 charges when the battery's potential falls below the charging voltage of the energy harvesting circuit 602. In the illustrated embodiment, a diode 612 such as, but not limited to a Schottkey diode, is utilized to prevent the possibility of a backwards discharge of the battery 610. The illustrated configuration allows current to flow from the solar cell 606 into the battery 610 with minimal voltage losses (potential drop across the diode 612) while preventing current flow from the battery 610 back into the energy harvesting circuit 602.

Rechargeable batteries typically have limits on their input charging voltage. Thus, the energy harvesting circuit 602 may operate to limit the charging voltage to prevent damage to the battery 610. The energy harvesting circuit 602 may take the form of a multi-terminal integrated circuit and several sub-components such as, but not limited to a small, simple six-pin integrated circuit made by SEIKO®.

Figure 7:
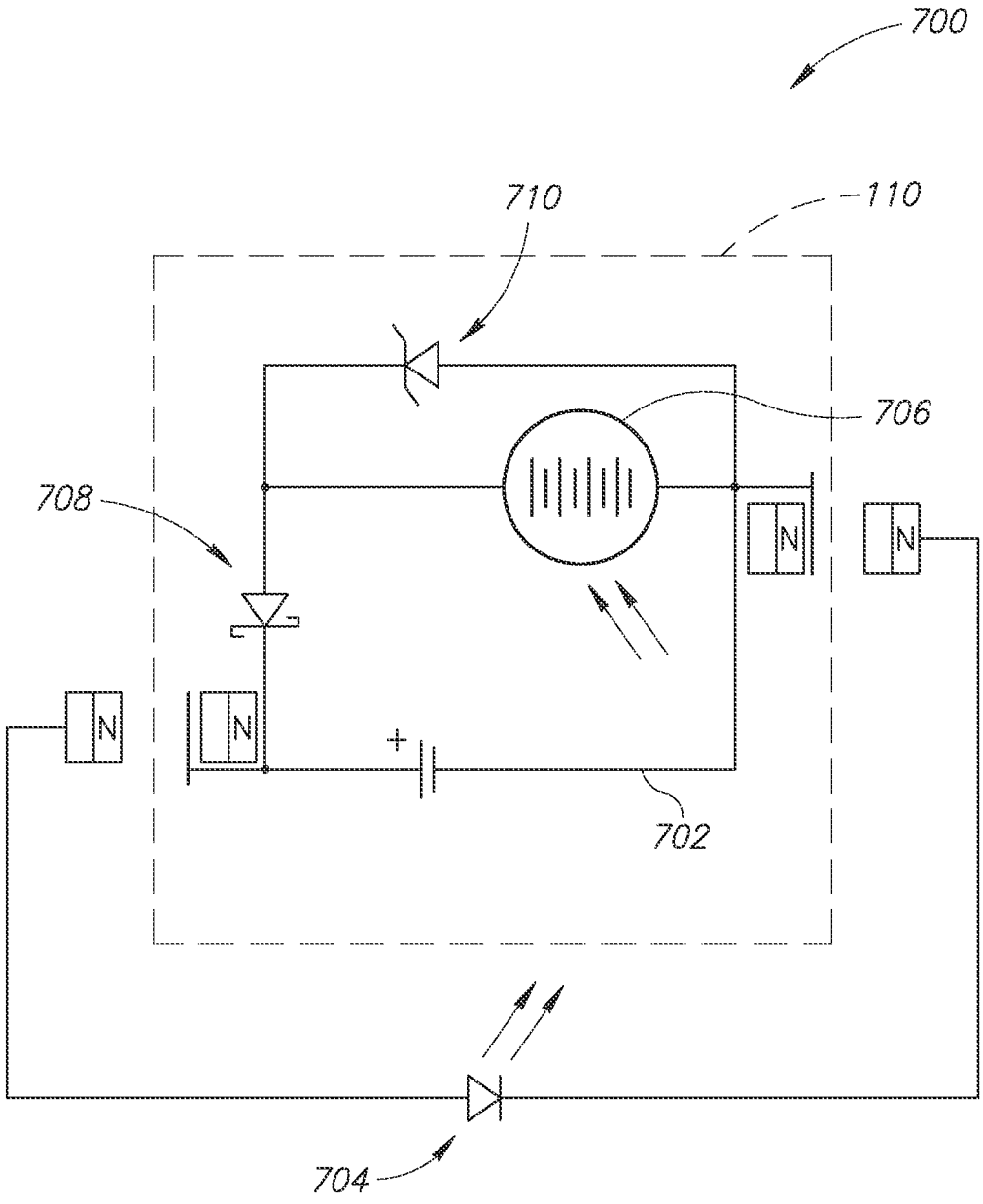
FIG. 7 is a schematic diagram for an illuminating jewelry system according to an embodiment of the present invention.

FIG. 7 shows a schematic circuit 700 for the power cell 110 (FIG. 1A) according to another embodiment of the present invention. By way of example, the circuit 700 within the power cell 110 is designed to be electrically efficient, and therefore relies on carefully matched components as opposed to 'smart' charging circuits which use power to drive logic functions. A battery 702 is selected such that a single cell has a high enough voltage to drive the light emitting diode (LED) 704. In addition, the internal resistance of the battery 702 should be such that the current flow through the LED 704 is within a safe operating tolerance. In other words, the battery 702 is sized to match the operational parameters of the LED 704. Using this method reduces the number of external electrical components within the housing and minimizes resistive losses.

The solar cell 706 preferably generates sufficient voltage for charging the battery 702. By way of example, the solar cell 706 may include several cells in series. Further, the properties of the solar cell 706 are matched to meet the charging requirements of the battery 702.

When the solar cell 706 is exposed to light a voltage is generated across its terminals. When this voltage exceeds a predetermined threshold then the battery 702 will charge. If the voltage across the battery 702 is greater than the voltage across the solar cell 706 then the battery 702 may discharge through the solar cell 706. To prevent this backwards or reverse discharge, the solar cell 706 is connected to the battery 702 through a Schottkey diode 708, which allows current to flow from the solar cell 706 into the battery 702 with minimal voltage losses (potential drop across the diode) while preventing current flow from the battery 702 back into the solar cell 706.

Rechargeable batteries have limits on the input charging voltage. A Zener diode 710 may be used to insure that the voltage generated by the solar cell 706 does not exceed the recommended charging voltage. The reverse breakdown voltage of the Zener diode 710 should preferably be matched to the recommended charging voltage of the battery 702. Using a single-cell battery 702, a small solar cell 706, and two diodes 708, 710, all with carefully selected properties, preferably provides the minimal number of components to make a safe solar-rechargeable power source.

Referring to FIG. 7, the LED 704 illuminates when the negative and positive terminals of the battery 702 make contact with the cathode (negative) and anode (positive) sides of the LED 704, respectively. Rather than require the end user to identify the negative side of the magnetic connector 710 and cathode side of the LED 704, the magnet polarities of both the magnetic connector 710 may be oriented such that the cathode side of the LED 704 will ONLY attach to the negative electrical contact (and the anode side of the LED 704 makes contact with the positive electrical contact). The polarities of the magnets are such that the LED connectors will enforce the requirements for positive current flow through the LED.

It may be desirable to modulate the light intensity as a function of time. By way of example the power cell circuit may be configured such that the LED flashes periodically, dims or changes color. To achieve different visual effects the end user may incorporate or exchange differently configured power cells.

Modifying circuits may also be introduced by the end user via a second 'clasp' unit. The second unit, designed with similar magnet connectors, could connect in series with the clasp-battery unit. The modifying circuit could modulate the light as described above, or modulate the light in response to some other stimuli such as, but not limited to, a solar sensor could be used to change the illumination level based on the ambient lighting; a sound sensor could modulate the illumination level based on ambient sounds; a 'mood' necklace could change illumination based on a temperature measurement made at the surface of the skin; and a wireless sensor could couple the necklace response to any number of wireless compatible devices such as cell phones etc.

The system may advantageously allow that jewelers or artisans with little or no knowledge of electricity can easily incorporate the clasp, power cell, and light source into their own work. The proper electrical connections are provided by the design of the magnetic clasp and power cell.

The various embodiments described above can be combined to provide further embodiments. All of the above U.S. patents, patent applications and publications referred to in this specification are incorporated herein by reference. Aspects can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all types of dispensers, organizers and methods of making and installing the same that operate in accordance with the claims. Accordingly, the invention is not limited by the disclosure, but instead its scope is to be determined entirely by the following claims

The invention claimed is:

1. An illuminatable jewelry system comprising:

a length of electrically-conductive stringing material having a first end and a second end, and an illuminatable element comprising a light emitting diode disposed therebetween, the light emitting diode comprising a cathode side electrically connected to the first end of the electrically-conductive stringing material and an anode side electrically connected to the second end of the electrically-conductive stringing material;

a first magnetic connector having a first end and a second end, the first end of the first magnetic connector being electrically coupled to the first end of the electrically-conductive stringing material, and the second end of the first magnetic connector having a first magnetic polarity;

a second magnetic connector having a first end and a second end, the first end of the second magnetic connector being electrically coupled to the second end of the electrically-conductive stringing material, the second end of the magnetic connector having a second magnetic polarity, wherein the second magnetic polarity is the opposite of the first magnetic polarity; and a power cell, the power cell comprising:

a negative terminal comprising a third magnetic connector having a first end and a second end, the first end of the third magnetic connector being electrically coupled to the negative terminal of the power cell, and the second end of the third magnetic connector having the second magnetic polarity; and a positive terminal comprising a fourth magnetic connector having a first end and a second end, the first end of the fourth magnetic connector being electrically coupled to the positive terminal of the power cell, and the second end of the fourth magnetic connector having the first magnetic polarity;

wherein proper current flow from the power cell, through the length of electrically-conductive stringing material, and through the light emitting diode is automatically ensured when (i) the second end of the first magnetic connector is magnetically mounted to the second end of the third magnetic connector, and (ii) the second end of the second magnetic connector is magnetically mounted to the second end of the fourth magnetic connector.

2. The illuminatable jewelry system of claim 1, further comprising decorative elements attached to the electrically-conductive stringing material, wherein the decorative elements do not emanate light.

3. The illuminatable jewelry system of claim 1, wherein the power cell is replaceable with a different power cell to achieve different lighting effects.

4. The illuminatable jewelry system of claim 1, wherein the illuminatable element comprises a glass capillary tube.

5. The illuminatable jewelry system of claim 1, wherein the power cell includes a solar cell.

6. The illuminatable jewelry system of claim 5, wherein the power is harvested from the solar cell using an energy harvesting circuit.

7. The illuminatable jewelry system of claim 1, wherein the power cell includes a rechargeable battery.

8. An illuminatable jewelry system according to claim 1 wherein the power cell is removable from the illuminatable jewelry system, and the first and second magnetic connectors are coupleable to one another.

* * * * *